United States Patent [19]

Suris

[11] Patent Number: 4,958,715

[45] Date of Patent: Sep. 25, 1990

[54] TRANSPORT SYSTEM FOR CURRENCY VALIDATOR

[75] Inventor: Vladimir Suris, Mayfield Hts., Ohio

[73] Assignee: Ardac, Inc. (Dixie-Narco, Inc.), Eastlake, Ohio

[21] Appl. No.: 325,990

[22] Filed: Mar. 20, 1989

[51] Int. Cl.[5] ..... G07F 7/04; B07C 5/00

[52] U.S. Cl. ..... 194/206

[58] Field of Search ..... 194/206, 207; 209/534; 271/180, 181

[56] References Cited

U.S. PATENT DOCUMENTS

| | | | |
|---|---|---|---|
| 3,256,968 | 6/1966 | Riddle et al. | 194/207 |
| 3,293,543 | 12/1966 | Nelson et al. | 209/569 X |
| 4,585,125 | 4/1986 | Mori et al. | 209/534 |
| 4,722,519 | 2/1988 | Zouzoulas | 271/181 |
| 4,858,744 | 8/1989 | Dolejs et al. | 194/206 |

*Primary Examiner*—F. J. Bartuska

*Attorney, Agent, or Firm*—Renner, Kenner, Greive, Bobak, Taylor & Weber

[57] ABSTRACT

Transport system for a currency validator in which an infeed belt makes frictional engagement with a vertical belt and is driven by a bite generated therebetween. The bite exists at an area of directional change in a note path such that a piece of paper tendered as valid currency changes its direction of movement from horizontal to vertical in that area. Maintained in that area is a magnetic reading head which arcuately engages a third belt. As the note passes along the note path, it is urged between the third belt and magnetic reading head such that it makes arcuate engagement with the reading head to increase the resolution and accuracy obtain thereby.

8 Claims, 1 Drawing Sheet

TRANSPORT SYSTEM FOR CURRENCY VALIDATOR

TECHNICAL FIELD

The invention herein resides in the art of currency validators and, more particularly, to the type employing magnetic reading heads along the note path within the acceptor.

BACKGROUND ART

Heretofore, various types of currency validators have been known. Typically, such validators are either of the "tray" or "slot" acceptor type. The invention herein is particularly adapted for implementation in slot acceptors in which a paper, offered as a valid note or piece of currency is transported through a testing area in which various tests are performed on the paper to determine its authenticity. Subsequently, the bill is carried among a note path to an escrow station where it is maintained until a requested transaction is completed, at which point the bill is dropped, punched, or otherwise inserted into a stacker. In such systems, numerous tests are performed on the paper to determine its authenticity. Such tests seek to confirm that the size, images, colors, patterns, inks, and the like on the paper being tendered are indicative of a valid piece of currency. An important element for testing the characteristics of the ink on the paper is a magnetic reading head, the same having found widespread use in the industry for such tests.

In the prior art, it has been known that the magnetic reading head must be maintained in close proximity to the tendered paper for purposes of test accuracy, resolution, and repeatability. In the past, the paper has been urged against the magnetic reading head by spring-biased rollers, or fixed physical structures maintained in close juxtaposition to the magnetic reading head. However, the prior art structures have typically resulted in only tangential contact with the reading head and, with a small area of contact, the tests have often been unreliable and subject to concern for errors. The prior art structure has been extremely sensitive, requiring careful adjustment, and often resulting in the generation of additional friction in the note transport system, requiring additional belt drive and the resultant generation of electronic noise.

The present trend in currency validators is vertical slot acceptors in which the paper is received within a slot, thence transported along a note path which quickly transforms from a horizontal to a vertical path. Securement of the paper in the transitional zone from horizontal to vertical is generally difficult to maintain. However, if the movement of the paper through such zone is ineffective, the system may jam, or the validation test may improperly fail.

In light of the foregoing, there is a need in the art for a magnetic sensing head system in which the area of contact between the note and the reading head is arcuate, rather than tangential, resulting in an increased area of such contact. There is a further need for guide means for urging the note against the magnetic reading head which is self-aligning. There is a further need in the art for a magnetic reading head system in which the guide means for urging the note against the magnetic reading head is self-tensioning. There is also a need for a transport system which efficiently and effectively moves the note through the transition from a horizontal path to a vertical path.

DISCLOSURE OF INVENTION

In light of the foregoing, it is a first aspect of the invention to provide a magnetic head pressure belt system for a currency validator which arcuately passes the note across the magnetic head.

It is a further aspect of the invention to provide a magnetic head pressure belt system for a currency validator in which guide means for urging the note against the head are self-aligning.

It is still a further aspect of the invention to provide a magnetic head pressure belt system for a currency validator in which such guide means are self-tensioning.

Yet another aspect of the invention is the provision of a note transport system for a currency validator in which a note may be efficiently and effectively transported from a horizontal path to a vertical path.

The foregoing, and other aspects of the invention which will become apparent as the detailed description proceeds are achieved by a magnetic reading head system for a currency validator, comprising: a transport system for moving a note along a note path, said note path being characterized by an area of directional change; and a magnetic reading head positioned at said area of directional change and adapted for contacting engagement with a note transported therealong.

Other aspects of the invention are achieved by a note transport system for a currency validator, comprising: a first belt rotatable about a first pulley assembly in a generally vertical direction; and a second belt rotatable about a second pulley assembly, a first portion of said second belt moving in a generally horizontal direction, a second portion of said second belt moving in a generally vertical direction, ar area of directional change being interposed between said first and second portions.

DESCRIPTION OF DRAWING

For a complete understanding of the objects, techniques, and structure of the invention, reference should be had to the following detailed description and accompanying drawing, wherein.

BEST MODE FOR CARRYING OUT THE INVENTION

Figure 1:
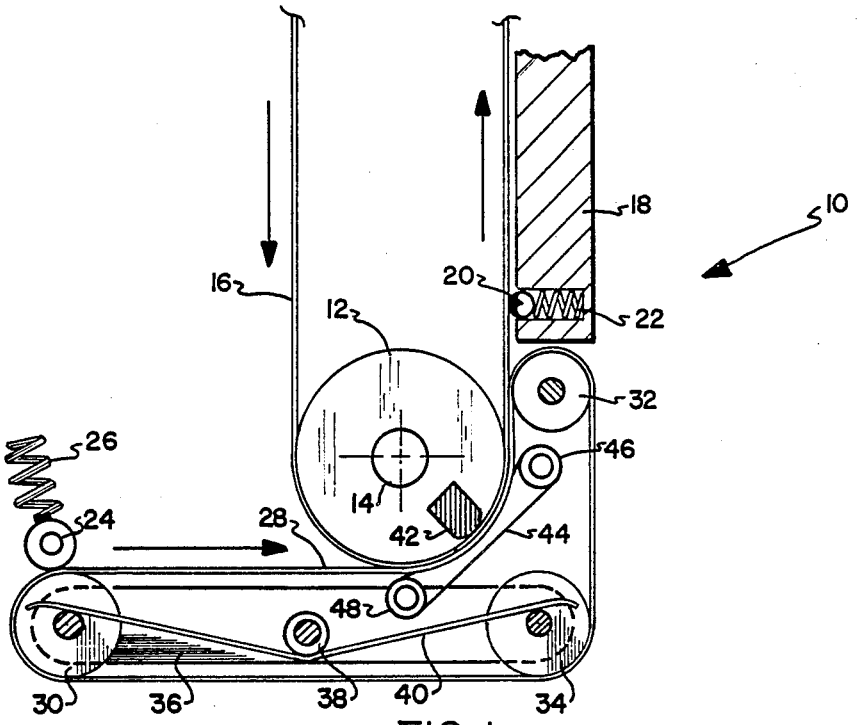
FIG. 1 is a side view of the transport system and note path of the invention.

Referring now to the drawing and more particularly FIG. 1, it can be seen that a note transport system for a "slot" type currency validator is designated generally by the numeral 10. As is customary in many such systems, there is provided a drive pulley 12, driven by a motor about an axis 14. A drive belt 16 engages the drive pulley 12 and is caused to move in a generally vertical direction as indicated by the arrows. It will, of course, be appreciated that the drive belt 16 would pass about a top free wheeling pulley at the end of the note path, such that the belt 16 is of a continuous nature.

The belt 16 is spaced from, but in juxtaposition to, a bill rail 18. Received within the bill rail 18, and spaced therealong, are ball bearings 20 which are biased by appropriate springs 22. As will be readily understood by those skilled in the art, a paper tendered as a valid currency or note is transported by the belt 16 along the bill rail 18 as facilitated by the bearings 20. There is, of course, a bite generated between the belt 16 and the bearings 20 such that the paper is transported by frictional engagement with the belt 16.

As understood by those skilled in the art, there would typically be a pair of drive belts 16, spaced apart from each other a distance slightly less than the width of the notes to be tested. There would also be a similarly spaced pair of bill rails 18 and drive pulleys 12. In the side illustrative view of FIG. 1, only one such assembly is shown, it being understood that the other assembly would be parallel to that structure just described and positioned into the paper of FIG. 1.

At the input end of the note transport system 10 is a feed roller 24 biased by a spring 26 and being free wheeling about an appropriate axis. A drive belt 28 is maintained about rollers 30–34. In a preferred embodiment, the rollers 30, 32 are free wheeling about a fixed axis, while the roller 34 is free wheeling about a floating axis. It will further be noted that the floating axis roller 34 is in substantial horizontal alignment with the roller 30 and in substantial vertical alignment with the roller 32. A bar 36 interconnects the axes of rotation of the rollers 30,34 to maintain the spacing therebetween. A fixed pin 38 receives a torsion or leaf spring 40 thereabout which engages the rotational axis of the roller 30 at a first end thereof and the rotational axis of the roller 34 at an opposite end thereof. Accordingly, the spring 40 acts as a tensioning device to urge the roller 34 downward as shown in the drawing.

It will be appreciated from reference to FIG. 1 that the driven belt 28 has a first horizontal portion following the bite formed with the feed roller 24. There is also provided a substantial vertical take-up portion of the belt 28, the same being interconnected with the horizontal infeed portion by an area of directional change therebetween. It will be appreciated that the spring 40 urges the belt 28 onto the belt 16 at this area of directional change, such that the belt 28 is driven by the belt 16. Further, this area of engagement forms a bite between the belts 16,28 in the area of directional change and in the vertical area therebetween.

It will again be appreciated by those skilled in the art that a pair of belts 28 would typically be employed, one associated with each of the pair of belts 16 and in alignment and engagement therewith. Accordingly, there would also be corresponding pairs of rollers 30–34 and other requisite structure. However, it is contemplated that the pairs of rollers may be interconnected by common axes, such that only a single tensioning spring 40 need to be provided. It may, however, be found that each of the assemblies 28–36 requires its own tensioning spring, in which case the same may be provided.

It should now be apparent that a note can be tendered into the bite created between the feed roller 24 and belt 28, moving in the direction of the arrow by frictional engagement with the belt 16 at the bite generated in the area of directional change. The belt is transported from the entry slot along the first horizontal portion of the belt 28 to the area of directional change where it is engaged by the bite generated between the pairs of belts 16,28. There, the direction of the note, securely engaged between both pairs of belts 16,28 is changed from horizontal to vertical and passed upwardly along the bill rail 18. Testing of the bill along this path may be accomplished by means of a magnetic reading head 42 maintained at the area of directional change to obtain arcuate contacting engagement with the paper note. The magnetic head 42 may either be fixed or biased as by means of a spring or the like. In either event, the positioning of the reading head 42 at the area of curvature assures a maximum area of contacting engagement, with resultant increases in resolution and accuracy.

Figure 2:
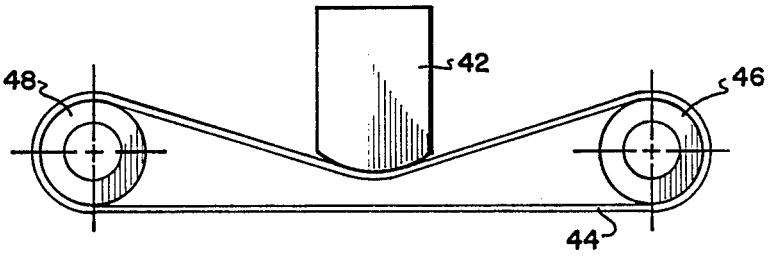
FIG. 2 is a side view of a magnetic head pressure belt assembly according to the invention.

As part and parcel of the invention, the magnetic head pressure belt 44 is maintained between a pair of free wheeling rollers 46,48 at the point of directional change and in alignment and contacting engagement with the reading head 42. The rollers 46,48 may rotate about fixed axes, or one such axis may be fixed and the other floating and spring-biased to assure self-alignment and adjustment of the belt 42 against the pressure head 44. Most particularly, it is desired that the belt 44 be in sufficient contacting engagement with the head 42 to assure that the note passing therebetween is urged into contacting engagement with the reading head, but without such friction as would impede the free movement of the note there across. It will be observed from both FIGS. 1 and 2 that the magnetic reading head 42 actually deflects the belt 44 to obtain the desired arcuate contacting engagement. While in a preferred embodiment of the invention the rollers 46,48 are free wheeling, it is also contemplated that one of them may be geared directly to the motor for the drive pulleys 12, or to its own drive motor, such that the belts 16,28,44 have the same linear velocity.

Figure 3:
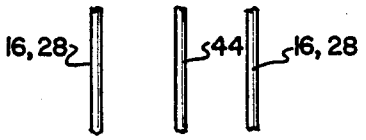
FIG. 3 is a partial top plan view of the belt arrangement of the invention at the point of curvature in the note path.

FIG. 3 is presented for purposes of illustration to show that the pairs of belts 16 are in alignment with the belts 28, and particularly at the area of directional change in the belt 28 spaced therebetween is the magnetic head pressure belt 44, operative about the free wheeling rollers 46,48.

In operation, when a note is tendered to the bite between the rollers 24 and belts 28, a sensor will activate a motor to drive the pulley 12 and begin the vertical rotation of the belt 16. The bite between the belts 16 and the belts 28 causes movement of the belt 28 as shown in the drawing, with the resultant transport of the note occurring. As the note enters the bite between the belts 16,28, the note path becomes arcuate. At the point, the note also enters the bite between the magnetic head 42 and the belt 44 such that the head 42 can "read" the note. The free wheeling or geared movement of the belt 44 reduces friction at the point of engagement with the head 44, while assuring a close proximity of the note with the magnetic head over a broad arcuate area. As the note leaves the bite between the belts 16,28, it continues to be transported by the belt 16 through the bite generated with the bearings 20. The bill is then held in escrow until the transaction is complete, at which time it is punched or otherwise placed into a stacker.

Thus it can be seen that the objects of the invention have been satisfied by the structure presented hereinabove. While in accordance with the patent statutes, only the best mode and preferred embodiment of the invention has been presented and described in detail, it is to be understood that the invention is not limited thereto or thereby. Accordingly, for an appreciation of the true scope and breadth of the invention, reference should be had to the following claims.

What is claimed is:

1. A magnetic reading head system for a currency validator, comprising:

a transport system for moving a note along a note path, said note path being characterized by an area of directional change; and a magnetic reading head positioned at said area of directional change and adapted for contacting engagement with a not transported therealong;

said transport system comprising:

a pair of first belts in spaced apart parallel relation, each rotatable about one of a pair of first pulley assemblies; and a pair of second belts in spaced apart parallel relation, each rotatable about one of a pair of second pulley assemblies, a first portion of each of said second belts moving in a generally horizontal direction, a second portion of each of said second belts moving in a generally vertical direction, said area of directional change being interposed between said first and second portions, respective ones of said first and second belts being in surface contacting engagement with each other at said second portions and area of directional change and adapted for receipt of a note therebetween; and a third belt interposed between said pairs of first and second belts at said area of directional change, said third belt in contacting engagement with said magnetic reading head and rotatable about a third pulley assembly,

2. The magnetic reading head system according to claim 1 wherein said third pulley assembly is free wheeling.

3. The magnetic reading head system according to claim 1 wherein said third pulley assembly is driven.

4. The magnetic reading head system according to claim 1 wherein said magnetic reading head deflects said third belt, and wherein said third belt and magnetic reading head are adapted for receipt of a note therebetween.

5. The magnetic reading head system according to claim 8 wherein said third belt is deflected to attain a same curvature as said first and second belts at said area of directional change.

6. The magnetic reading head system according to claim 1 wherein said first belts are drive belts and said second belts are driven belts.

7. The magnetic reading head system according to claim 6 wherein said second pulley assembly is spring biased for urging contacting engagement between said first and second belts.

8. The magnetic reading head system according to claim 7 wherein said second pulley system includes two fixed pulleys, a floating pulley, and a spring in biasing engagement with said floating pulley.

* * * * *